US011142228B2

(12) United States Patent
Sunde et al.

(10) Patent No.: US 11,142,228 B2
(45) Date of Patent: Oct. 12, 2021

(54) CUSHIONING UNIT WITH REDUCED TAIL YOKE

(71) Applicant: Strato, Inc., Piscataway, NJ (US)

(72) Inventors: Jonathan Sunde, Somerset, NJ (US); Michael Ring, Lake Village, IN (US)

(73) Assignee: Strato, Inc., Piscataway, NJ (US)

( * ) Notice: Subject to any disclaimer, the term of this patent is extended or adjusted under 35 U.S.C. 154(b) by 378 days.

(21) Appl. No.: 16/250,267

(22) Filed: Jan. 17, 2019

(65) Prior Publication Data

US 2020/0231191 A1 Jul. 23, 2020

(51) Int. Cl.
*B61G 11/08* (2006.01)
*B61G 11/18* (2006.01)

(52) U.S. Cl.
CPC ..... *B61G 11/08* (2013.01); *B61G 11/18* (2013.01)

(58) Field of Classification Search
CPC ..... B61G 11/00; B61G 11/08; B61G 11/18; B61G 9/00; B61G 9/04; B61G 9/06; B61G 9/12; B61G 9/14
See application file for complete search history.

(56) References Cited

U.S. PATENT DOCUMENTS 2,469,126 A 5/1949 Munro et al.
2,559,743 A 7/1951 Williams
2,706,050 A 4/1955 Sprouse
2,728,465 A 12/1955 Campbell
2,766,894 A 10/1956 Campbell
2,825,472 A 3/1958 Peterson
2,970,703 A 2/1961 Blattner
3,197,037 A * 7/1965 Willison ..... B61G 7/10 213/21
3,370,718 A 2/1968 Waddell
3,622,015 A 11/1971 Atkinson et al.
3,712,479 A 1/1973 Atkinson
3,800,961 A 4/1974 Hawthorne
3,827,575 A 8/1974 Mosier et al.
3,838,778 A * 10/1974 Appleton ..... B61G 9/06 213/45
5,312,007 A 5/1994 Kaufhold et al.
(Continued)

FOREIGN PATENT DOCUMENTS

GB 919899 2/1963

OTHER PUBLICATIONS

PCT International Search Report and Written Opinion of corresponding PCT appl. No. PCT/US2019/066441 dated Feb. 14, 2020.
(Continued)

*Primary Examiner* — Robert J McCarry, Jr.
(74) *Attorney, Agent, or Firm* — AP Patents; Alexander Pokot

(57) ABSTRACT

A cushioning apparatus for a railway car employs a shortened yoke with a reduced-width tail for placement between stops in a conventional railway car sill. A first stack of rigid plates with elastomeric pads is provided between the straps of the modified yoke behind the coupler follower, and a second stack of plates and elastomeric pads is positioned in the sill behind the modified yoke to absorb buff loads on the coupler. In embodiments, the entire assembly may be placed in a sill having forward stops, intermediate stops, and rear stops, adapted to house a hydraulic cushioning unit.

16 Claims, 4 Drawing Sheets

(56) References Cited

U.S. PATENT DOCUMENTS

| | | | | |
|---|---|---|---|---|
| 5,487,480 | A | 1/1996 | Page et al. | |
| 6,360,906 | B1 | 3/2002 | Kaufhold et al. | |
| 6,446,820 | B1 * | 9/2002 | Barker | B61G 9/06 213/46 R |
| 6,681,943 | B2 | 1/2004 | Barker et al. | |
| 8,590,717 | B2 | 11/2013 | Wilt et al. | |
| 8,870,002 | B2 | 10/2014 | Wilt et al. | |
| 8,939,300 | B2 | 1/2015 | Wilt et al. | |
| 8,985,355 | B2 | 3/2015 | Wilt | |
| 9,056,618 | B2 | 6/2015 | Gagliardino et al. | |
| D781,179 | S | 3/2017 | Schoedl et al. | |
| 9,598,092 | B2 | 3/2017 | James et al. | |
| 9,669,848 | B2 | 6/2017 | Creighton et al. | |
| 9,789,888 | B2 | 10/2017 | Wilt et al. | |
| 9,868,453 | B2 * | 1/2018 | Johnson | B61G 3/06 |
| 10,011,288 | B2 | 7/2018 | Gagliardino et al. | |
| 10,086,853 | B2 | 10/2018 | Hartman et al. | |
| 10,308,263 | B1 | 6/2019 | Ring et al. | |
| 10,513,042 | B2 | 12/2019 | Coffland et al. | |
| 2002/0070189 | A1 | 6/2002 | Barker et al. | |
| 2006/0043044 | A1 | 3/2006 | Ring et al. | |
| 2008/0008225 | A1 | 1/2008 | Ahmad et al. | |
| 2008/0011700 | A1 * | 1/2008 | Brough | B61G 9/24 213/75 R |
| 2013/0270210 | A1 | 10/2013 | Kukulski et al. | |
| 2015/0251671 | A1 | 9/2015 | Iler | |
| 2015/0307115 | A1 | 10/2015 | Wang et al. | |
| 2017/0080956 | A1 | 3/2017 | James et al. | |
| 2017/0166225 | A1 | 6/2017 | Schoedl et al. | |
| 2017/0210398 | A1 | 7/2017 | Wilt et al. | |
| 2017/0334469 | A1 | 11/2017 | Johnson et al. | |
| 2018/0118235 | A1 | 5/2018 | Johnson et al. | |
| 2019/0144015 | A1 | 5/2019 | Ring et al. | |

OTHER PUBLICATIONS

International Search Report and Written Opinion of corresponding PCT application No. PCT/US19/63837 dated Feb. 18, 2020.

* cited by examiner

CUSHIONING UNIT WITH REDUCED TAIL YOKE

BACKGROUND OF THE INVENTION

In a conventional frictional draft gear, one or more elastic elements, such as a coil spring or a set of elastomeric pads, is enclosed in a housing mounted in the yoke behind the coupler of a railway car. A piston-like element frictionally received in the housing absorbs buff loads transmitted via a coupler follower which moves inside the yoke in response to buff impact force applied on the coupler, and the draft gear is compressed in the yoke in response to buff and draft forces. The basic draft gear apparatus has been used for decades. However, in many cases, unacceptably large forces are transmitted to the railway car and it is now desired to provide a cushioning apparatus that dissipates more force during impact than the conventional draft gear.

A solution has recently been proposed in U.S. Pat. No. 10,086,852 (which is incorporated by reference) to add a second draft gear in a railway car sill behind a standard yoke to absorb buff loads. However, the dual draft gear solution may not provide sufficient energy absorption. Merely doubling the 3¼ inches of travel provided by a single draft gear may not provide sufficient travel.

A hydraulic cushioning unit comprises a piston received in a cylinder filled with fluid. Such devices may dissipate more energy than a conventional draft gear, but they are known to be prone to leakage. Also, the fluid in a conventional hydraulic unit does not cushion draft forces on the coupler.

U.S. Pat. No. 5,487,480 is incorporated by reference herein for its description of a hydraulic end-of-car cushioning (EOCC) unit.

Selective cushioning apparatuses using elastomeric pads arranged on plates to absorb buff and draft loads on a coupler are described in co-pending application Ser. No. 15/814,853, filed Nov. 16, 2017 and Ser. No. 16/133,085, filed Sep. 17, 2018, which are incorporated by reference.

SUMMARY OF THE INVENTION

It is now desired to increase the applications for such selective cushioning apparatus. Particularly, it is desired to develop a selective cushioning apparatus which can fit into a sill having forward, intermediate and rear lugs or "stops" to accommodate a hydraulic cushioning unit without having to reconfigure the sill.

Thus, in one aspect, the invention is an end-of-car cushioning apparatus for a railway car adapted to be received in a sill, said sill having longitudinal, lateral and vertical dimensions, the cushioning apparatus comprising: a yoke adapted to be received in the sill having a nose at one end, a tail comprising a transverse tail wall at an end opposite the nose, straps extending from the tail wall to the nose, and an inside area between the straps; a coupler-receiving member adapted to receive buff force from the coupler and adapted to move inside the yoke; a first stack of elastomeric units positioned between the coupler-receiving member and the transverse tail wall of the yoke, each elastomeric unit in the first stack of elastomeric units comprising a first size rigid metal plate and at least one elastomeric pad positioned on said first size rigid metal plate; wherein said first stack of elastomeric units is compressed in response to buff and draft loads on the coupler; a second stack of elastomeric units positioned behind the vertical wall of the yoke, each elastomeric unit in the second stack of elastomeric units comprising a second size rigid metal plate and at least one elastomeric pad positioned on said second size rigid metal plate; wherein said second stack of elastomeric units is compressed in response to buff loads on the coupler; wherein, the transverse tail wall of the yoke is dimensioned to allow clearance between the yoke and a pair of intermediate stops on opposed inside surfaces of the sill. In embodiments, the second size rigid metal plates are larger (viewed as a vertical cross section in the sill) than the first size rigid metal plates, but they may also have the same size.

The modified yoke having a reduced-width transverse tail wall allows the yoke to be positioned between intermediate stops in a sill configured to house a hydraulic cushioning unit without reconfiguring the sill. In embodiments, the second stack of elastomeric units, absorbing only buff loads, abuts the assembly of the modified yoke and the first stack of elastomeric units at the intermediate stops.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
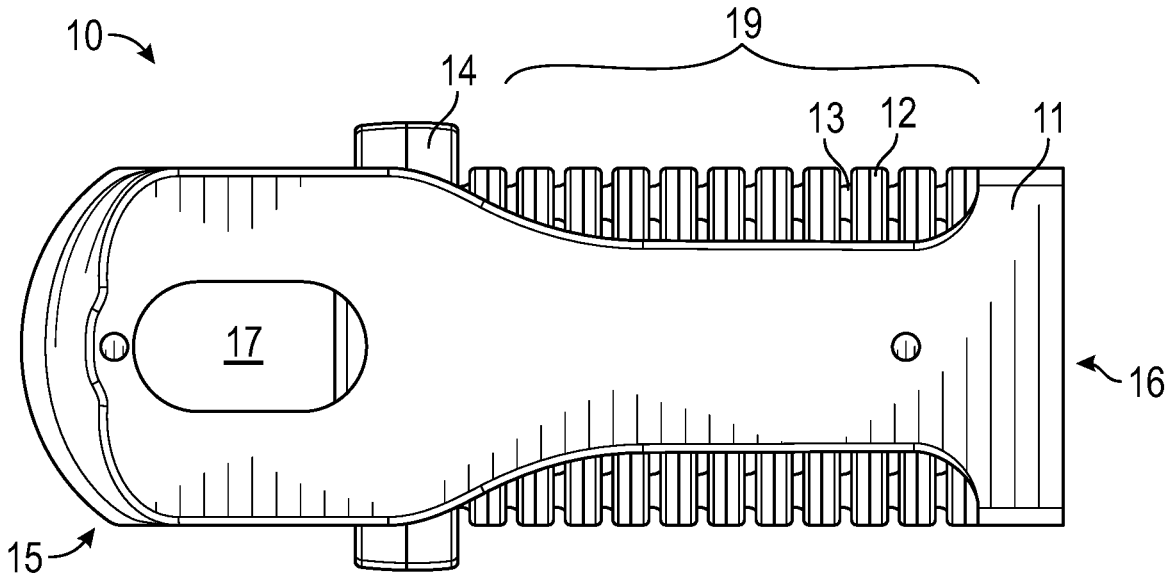
FIG. 1 depicts a top view modified yoke with a first set of elastomeric units received between the straps of the yoke behind the coupler follower, adapted for use with a cushioning apparatus according to an embodiment of the invention.

The drawings are schematic and may not be to scale and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of an element is in a direction away from the body of the car and "rear" is in the opposite direction, from the front end of the coupler toward the car body. Likewise, the "longitudinal" axis or direction is parallel to the rails and in the direction of movement of the railway car on the track in either direction. The "transverse" or "lateral" axis or direction is perpendicular to the longitudinal axis and parallel to the rail. A "transverse plane" or "vertical cross section" is a plane perpendicular to the longitudinal axis of the sill. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the surface the train travels on.

"Buff force" on the coupler means force applied when the coupler is urged in the inboard direction of the railway car, as when two railway cars impact one another. "Buff travel" refers to displacement of any element of the cushioning unit in response to buff force. "Draft" is opposite to buff force and is applied to a coupler when a locomotive pulls on a railway car train, for example. "Neutral" refers to the position of components before buff or draft forces are applied. Some elements and components of the invention, including the elastomeric pads, may be pre-stressed and pre-biased in the neutral condition.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives. Thermoplastic copolyesters used in some conventional draft gear may be used in the stacks of elastomeric units according to the invention.

As used herein, the term "about" associated with a numerical value is understood to indicate the numerical value as closely as possible, allowing for a margin of +/−20% of the value. With reference to specific standards, given dimensions vary at least within tolerances accepted in the railroad industry.

"Travel" refers to a distance traveled by the coupler follower upon impact and may also be referred to as "displacement". In some instances, clear from the context, "travel" refers to the full possible extent of movement, i.e., when the pads are fully compressed.

A person having ordinary skill in the art has a general knowledge of standards and procedures established by the Association of American Railroads ("AAR") and the published AAR standards cited herein are incorporated by reference as background. Reference herein to AAR standards refers to standards in effect on the filing date of this application. Draft gears for freight cars are certified under either section M-901E or section M-901G of the Association of American Railroads (AAR) Manual. Hydraulic units are tested using dynamic impact tests set out in AAR standards M-921B or M-921D. An E-Type yoke has the dimensions specified in AAR Standard S-143, which allows for a draft gear pocket of 24⅝ inch. An F-Type yoke has the dimensions specified in Standard S-149. In embodiments, a cushioning apparatus according to the invention fits between front and rear stops of an "EOC-9" dimensions of about 38¾ inches described in AAR standard S-183 or EOC-10 pocket with a pocket length of about 48¾ inches described in AAR standard S-184. In other embodiments, the cushioning device may be adapted to fit other AAR standard or non-standard pocket dimensions depending on the application.

A selective cushioning unit according to the invention comprises two stacks of elastomeric units. The first stack is behind the coupler receiving member (the "coupler follower") and in front of the tail wall of the yoke, where a draft gear is positioned in a conventional arrangement. The second stack is behind the yoke and absorbs only buff loads on the coupler. The dimensions of the first stack are determined by the geometry of the inside area of the yoke. The overall dimensions of the second stack are determined by the geometry of the sill behind the coupler. Although the size of the plates in each stack, viewed from a vertical cross section of the sill may vary, the stacks of elastomeric units according to the invention are substantially as described in co-pending application Ser. No. 15/814,853, filed Nov. 16, 2017 and Ser. No. 16/133,085, filed Sep. 17, 2018, which are incorporated by reference.

FIG. 1 shows modified yoke 11 with a reduced-width tail. Yoke 11 has a stack 19 of elastomeric units positioned between tail wall 16 and coupler follower 14. Stack 19 of elastomeric units comprises a plurality of substantially identical rigid metal plates 12, each having an elastomeric pad thereon between adjacent plates. A plate and a pad together are called an "elastomeric unit". In embodiments, mechanical stops 13 may be provided on plates 12 to prevent overcompression of elastomeric pads when stack 19 is compressed in response to draft or buff loads. At a predetermined amount of force, metal-on-metal contact is reached so that further deformation of the elastomeric pad is prevented. In embodiments, protrusions on one metal plate may mate with recesses on an adjacent plate at a predetermined amount of travel, so that adjacent plates in a stack are adapted to form a nested arrangement. Metal-to-metal contact on the stop surfaces occurs when an elastomeric pad between two adjacent plates is compressed a predetermined amount, such as 20-80%, and in embodiments 20-60%, of the uncompressed thickness of the pads. In embodiments, the pads in the front or draft stack compress about 0.5 inches (from their uncompressed thickness prior to installation) before metal to metal contact prevents further compression. In embodiments, the elastomeric pads are pre-stressed on installation. In embodiments, a protrusion on an elastomeric pad mates with a feature on an adjacent rigid plate to align the elastomeric units Oblong hole 17 receives pin 46 to attach modified yoke 11 to a coupler and to allow pin 46 to take different positions in hole 17 depending on the forces on the coupler and on the travel afforded by the first and second stacks of elastomeric units. As pin 46 is engaged only in draft, lengthening hole 17 allows for a shortened overall construction for the cushioning unit, with stack 59 of elastomeric units abutting end wall 16 shortened modified yoke. In embodiments, stacks 19 and 59 of elastomeric units absorb greater buff and draft loads than two conventional draft gear fitting in the same space, and may allow more travel than a combined pair of draft gears, each having a nominal 3.25 inches of travel. In a non-limiting embodiment, the length of oblong hole from end to end longitudinally is in a range of about 6 to 7 inches, for example 6.25 inches. When buff forces are applied, pin 46 is at the rear end of oblong hole 17, and in draft pin is at the forward end of the hole.

Figure 2:
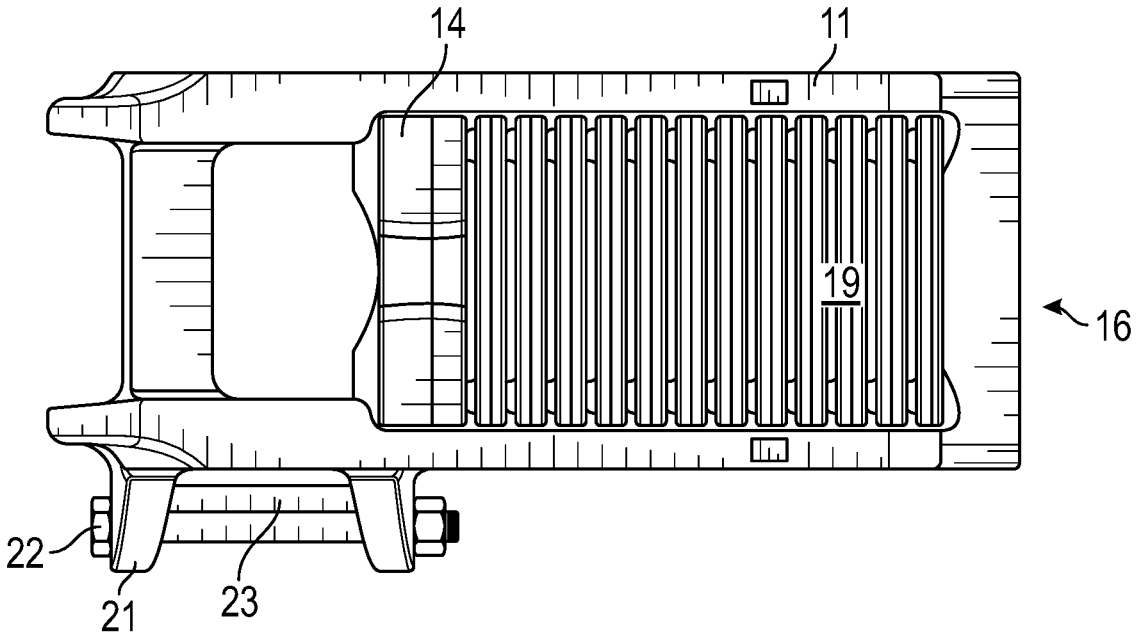
FIG. 2 depicts a side view of the modified yoke and stack of elastomeric units according to the embodiment depicted in FIG. 1.
Figure 3:
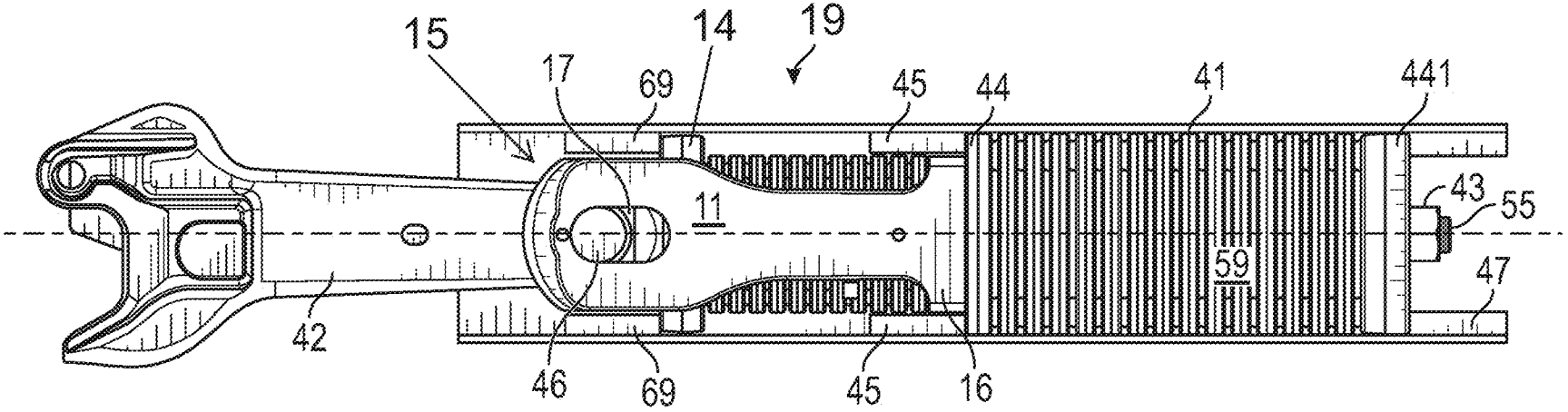
FIG. 3 depicts a top view of a cushioning apparatus according to an embodiment of the invention, installed with coupler in a conventional sill.
Figure 4:
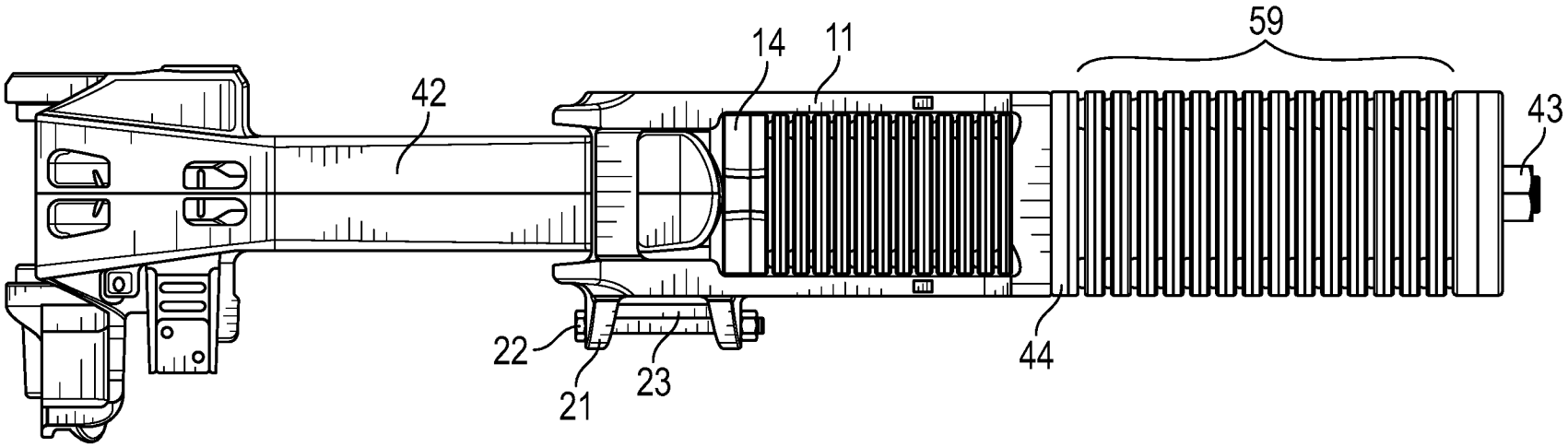
FIG. 4 depicts a side view of a cushioning apparatus according to an embodiment of the invention.
Figure 5:
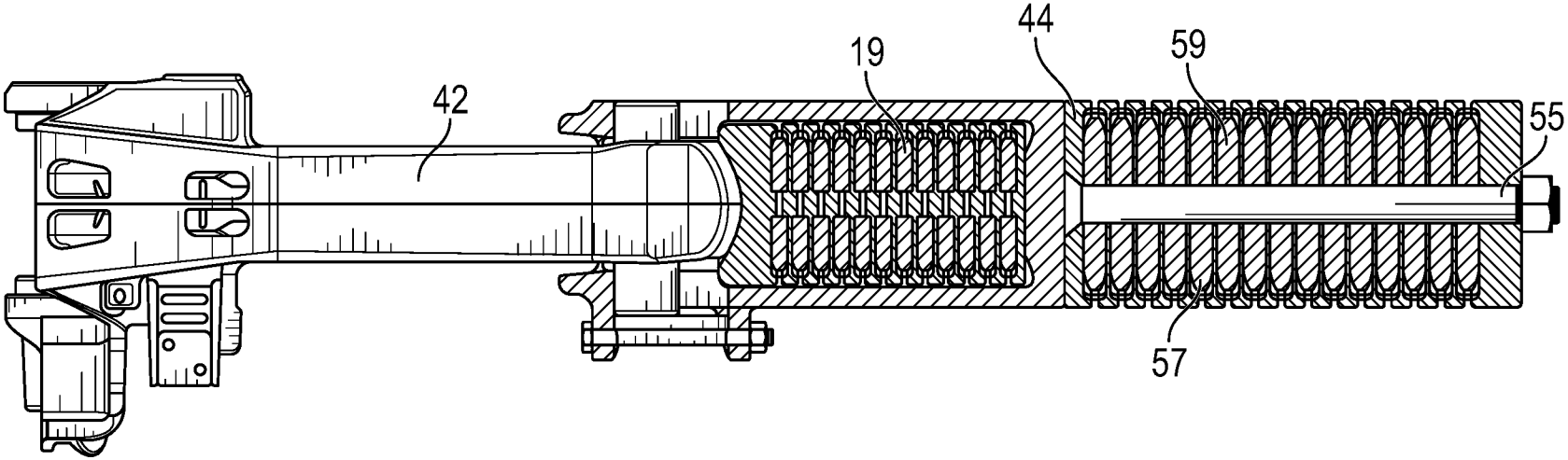
FIG. 5 depicts a cross section of the view of FIG. 4

FIG. 2 is a side view of the assembly of FIG. 1, showing a retainer system for pin 46 which facilitates removal of pin 46 to decouple yoke 11 from coupler 42. The retainer system in this embodiment includes an elongated puck 23 and a flange 21 and bolt 22 to hold puck 23 in place. The puck is elongated to match the size of hole 17.

A second stack 59 of elastomeric units may be positioned behind the modified yoke to absorb buff loads on the coupler. The second stack is similar to first stack, comprising a set of rigid metal plates with pads between them, but the metal plates and pads of the second stack may be larger because they need not fit between the straps of the yoke. In embodiments, the plates of the second stack are identical and substantially fill a vertical cross section of the sill. Second stack may be held between front and rear plates by one or more connecting rods and compressed to a predetermined neutral condition by a suitable fastener.

In the embodiment shown, second stack 59 is held together with a single connecting rod 55 which passes through a front plate 44, through a set of nested metal plates and elastomeric pads, through rear plate 441, and fastened behind rear plate 441 with a nut 43. In embodiments, stack 59 is sized to fit in a pocket adapted to house a hydraulic cushioning unit, between rear stops 47 and intermediate stops 45. Thus, second stack 59 and yoke 11 abut one another and together fill the entire length between front stops 69 and rear stops 47, such as in one embodiment 48¾ inches and in another embodiment 38¾ inches.

According to the invention, the nose 15 of the yoke 11 may be wider than the tail. Transverse tail wall 16 has a reduced width to fit between intermediate stops 45. The sill may have a nominal width of about 12 to 13 inches, for example 12.875 inches. Stops 45 may protrude about 0.5 to 2.0 inches from opposed inside surfaces of the sill, for example 1.5 inches on either side of the sill. Thus, the tail is designed to have a width reduced by about 1.0 inch to about 4.0 inches to fit between stops 45. For example, the yoke 11 may have a transverse tail wall 16 with a width of about 9 to about 10 inches.

The same elastomeric material may be used for the elastomeric pads in the draft stack as in the buff stack, such as a thermoplastic elastomer as described in the aforesaid co-pending applications incorporated by reference. In certain non-limiting embodiments, the pads may be made of thermoplastic polyester, such as Arnitel® thermoplastic copolyester elastomer from DSM and Hytrel® thermoplastic polyester from Dupont. Suitable materials will typically have a Shore D durometer hardness of 40-70 and must have reasonably consistent properties across a temperature range that would be encountered during use.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. An end-of-car cushioning apparatus for a railway car, the end-of-car cushioning apparatus adapted to be received in a sill, said sill having longitudinal, lateral and vertical dimensions, the end-of-car cushioning apparatus comprising:

a yoke adapted to be received in the sill, the yoke having a nose at one end, a tail comprising a transverse tail wall at an end opposite the nose, straps extending from the tail wall to the nose, and an inside area between the straps;

a coupler-receiving member adapted to receive buff force from a coupler and adapted to move inside the yoke;

a first stack of elastomeric units positioned between the coupler-receiving member and the transverse tail wall of the yoke, each elastomeric unit in thefirst stack of elastomeric units comprising a first size rigid metal plate and at least one elastomeric pad positioned on said first size rigid metal plate;

wherein said first stack of elastomeric units is compressed in response to buff and draft loads on the coupler;

a second stack of elastomeric units positioned behind the transverse tail wall of the yoke, each elastomeric unit in the second stack of elastomeric units comprising a second size rigid metal plate and at least one elastomeric pad positioned on said second size rigid metal plate;

wherein said second stack of elastomeric units is compressed in response to buff loads on the coupler;

the nose of the yoke comprising straight edge portions spaced apart from each other to define a width of the nose, the width of the nose being sized to allow a clearance between the nose and inside surfaces of a pair of front stops on opposed inside surfaces of the sill, the transverse tail wall of the yoke is dimensioned to allow clearance between the transverse tail wall of the yoke and the inside surfaces of a pair of intermediate stops on the opposed inside surfaces of the sill, the first size rigid metal plate and the at least one elastomeric pad in the first stack of elastomeric units being sized for a movement between the inside surfaces of the pair of intermediate stops on the opposed inside surfaces of the sill.

2. The end-of-car cushioning apparatus according to claim 1, wherein the second size rigid metal plates are larger, viewed as a vertical cross section of the sill, than the first size rigid metal plates.

3. The end-of-car cushioning apparatus according to claim 1, wherein each first size rigid metal plate has a first dimension bounded by the straps of the yoke and a second dimension, perpendicular to the first dimension, bounded by the pair of intermediate stops on the opposed inside surfaces of the sill; and wherein each second size rigid metal plate has vertical and lateral dimensions bounded by a vertical cross section of the sill.

4. The end-of-car cushioning apparatus according to claim 1, wherein the yoke has a length of about 28 to 29 inches, having a pocket adapted to accommodate a first stack ofelastomeric units having a length of about 19 to 20 inches, and wherein the width of thetransverse tail wall fitting between the intermediate stops is about 9 to 10 inches.

5. The end-of-car cushioning apparatus according to claim 1, wherein the second stack of elastomeric units abuts rear stops and the pair of intermediate stops on the opposed inside surfaces of the sill, wherein the coupler receiving member abuts forward stops on the opposed inside surfaces of the sill; and wherein a longitudinal distance between the forward stops and rear stops is in a range of about 38 to 39 inches.

6. The end-of-car cushioning apparatus according to claim 1, wherein the second stack of elastomeric units abuts rear stops and the pair of intermediate stops on the opposed inside surfaces of the sill, wherein the coupler receiving member abuts forward stops on the opposed inside surfaces of the sill; and wherein a longitudinal distance between the forward stops and rear stops is in a range of about 48 to 49 inches.

7. The end-of-car cushioning apparatus according to claim 1, wherein the rigid plates in the first stack of elastomeric units and in the second stack of elastomeric units are each adapted to contact an adjacent plate at a predetermined amount of compression of anelastomeric member between two adjacent plates.

8. The end-of-car cushioning apparatus according to claim 1, further comprising front and rear plates bounding the second stack of elastomeric units and a rod passing through the front and rear plates and the each elastomeric unit of the second stack of elastomeric units to hold the second stack together.

9. The end-of-car cushioning apparatus according to claim 1, further comprising an elongated hole adapted receive a coupler pin in a plurality of positions.

10. A railway car cushioning apparatus, comprising:

a yoke adapted to be received in a railway car sill, the yoke having a nose at one end, a tail comprising a transverse tail wall at an end opposite the nose, straps extendingfrom the tail wall to the nose, and an inside area between the straps;

a coupler-receiving member adapted to receive buff force from a coupler and adapted to move inside the yoke;

a stack of elastomeric units positioned between the coupler-receiving member and the transverse tail wall of the yoke, each elastomeric unit in the stack of elastomeric units comprising a rigid metal plate and at least one elastomeric pad positioned on the rigid metal plate;

wherein the stack of elastomeric units is compressible in a response to buff and draft loads on the coupler;

the nose of the yoke comprising straight edge portions spaced apart from each other to define a width of the nose, the width of the nose being sized to allow a clearance between the nose and inside surfaces of a pair of front stops on opposed inside surfaces of the railway car sill;

the transverse tail wall of the yoke being sized to allow a movement between the transverse tail wall of the yoke and inside surfaces of a pair of intermediate stops on the opposed inside surfaces of the railway car sill;

the rigid metal plate and the at least one elastomeric pad being sized for a movement between the inside surfaces of the pair of intermediate stops on the opposed inside surfaces of the railway car sill.

11. The railway car cushioning apparatus according to claim 10, further comprising another stack of elastomeric units positioned behind the tail wall of the yoke, each elastomeric unit in the another stack of elastomeric units comprising another rigid metal plate and at least one elastomeric pad positioned on the another rigid metal plate, the another stack of elastomeric units compressible in response to buff loads on the coupler.

12. The end-of-car cushioning apparatus according to claim 11, further comprising front and rear plates bounding the another stack of elastomeric units and a rod passing through the front and rear plates and the elastomeric units of the another stack to hold the another stack together.

13. The end-of-car cushioning apparatus according to claim 10, wherein each rigid metal plate comprises a mechanical stop.

14. A railway car yoke, comprising a nose at one end, the nose comprising straight edge portions spaced apart from each other to define a width of the nose, the width of the nose being sized to allow a clearance between the nose and inside surfaces of a pair of front stops on opposed inside surfaces of a railway car sill when the railway car yoke is installed into the railway car sill;

a tail at an end opposite the nose, the tail comprising a tail wall, the tail wall being sized to allow a clearance between the tail wall and inside surfaces of a pair of intermediate stops on the opposed inside surfaces of the railway car sill, the tail wall being disposed transverse to the opposed inside surfaces of the railway car sill; and two straps extending from the nose to the tail wall, the two straps being disposed at a distance from each other to define, in a combination with the opposed inside surfaces of the railway car sill, a pocket of the railway car yoke, a width of each strap being smaller than the width of the nose and a width of the tail wall.

15. The yoke according to claim 14, further comprising an elongated hole through the nose, the elongated hole being adapted to receive a coupler pin.

16. The yoke according to claim 14, further comprising a retainer system designed to facilitate a removal of a coupler pin.

* * * * *